US006129518A

United States Patent [19]

Ricco

[11] Patent Number: 6,129,518

[45] Date of Patent: Oct. 10, 2000

[54] PERFECTED PUMPING DEVICE FOR FEEDING FUEL FROM A TANK TO AN INTERNAL COMBUSTION ENGINE

[75] Inventor: Mario Ricco, Bari, Italy

[73] Assignee: Elasis Sistema Ricerca Fiat Nel Mezzogiorno Societa Consortile per Azioni, Pomigliano, Italy

[21] Appl. No.: 08/995,069

[22] Filed: Dec. 19, 1997

[30] Foreign Application Priority Data

Dec. 23, 1996 [IT] Italy ..... TO96A1076

[51] Int. Cl.[7] ..... F04B 23/12

[52] U.S. Cl. ..... 417/206; 417/251; 417/253

[58] Field of Search ..... 417/205, 251, 417/253, 206; 184/6.5

[56] References Cited

U.S. PATENT DOCUMENTS

| | | | |
|---|---|---|---|
| 4,708,116 | 11/1987 | Gaa et al. | 123/506 |
| 4,915,592 | 4/1990 | Hishinuma et al. | 417/206 |
| 5,131,817 | 7/1992 | Pastore, Jr. | 417/69 |
| 5,378,125 | 1/1995 | Frank et al. | 417/423.3 |
| 5,393,203 | 2/1995 | Hantle | 417/203 |
| 5,551,842 | 9/1996 | Schmid et al. | 417/203 |
| 5,571,243 | 11/1996 | Arnold et al. | 123/198 DB |
| 5,836,421 | 11/1998 | Leicht | 184/6.2 |
| 5,884,597 | 3/1999 | Hiraku et al. | 123/179.17 |

FOREIGN PATENT DOCUMENTS 3718607 10/1987 Germany .

*Primary Examiner*—Charles G. Freay
*Assistant Examiner*—Cheryl J. Tyler
*Attorney, Agent, or Firm*—Patton Boggs LLP

[57] ABSTRACT

An on-off valve is connected between a high-pressure pump and a low-pressure pump and is sized to be rapidly activated during the cranking stage of an internal combustion engine. After actuating the on-off valve, surplus fuel is drained into an inner chamber of the high pressure pump. A solenoid valve is further provided between the low-pressure pump and the on-off valve to automatically cut off the supply of fuel to the on-off valve in the event of an engine failure. The apparatus is beneficial to reduce variation in the fuel supply of the low pressure pump during engine start-up and steady-state operation.

10 Claims, 1 Drawing Sheet

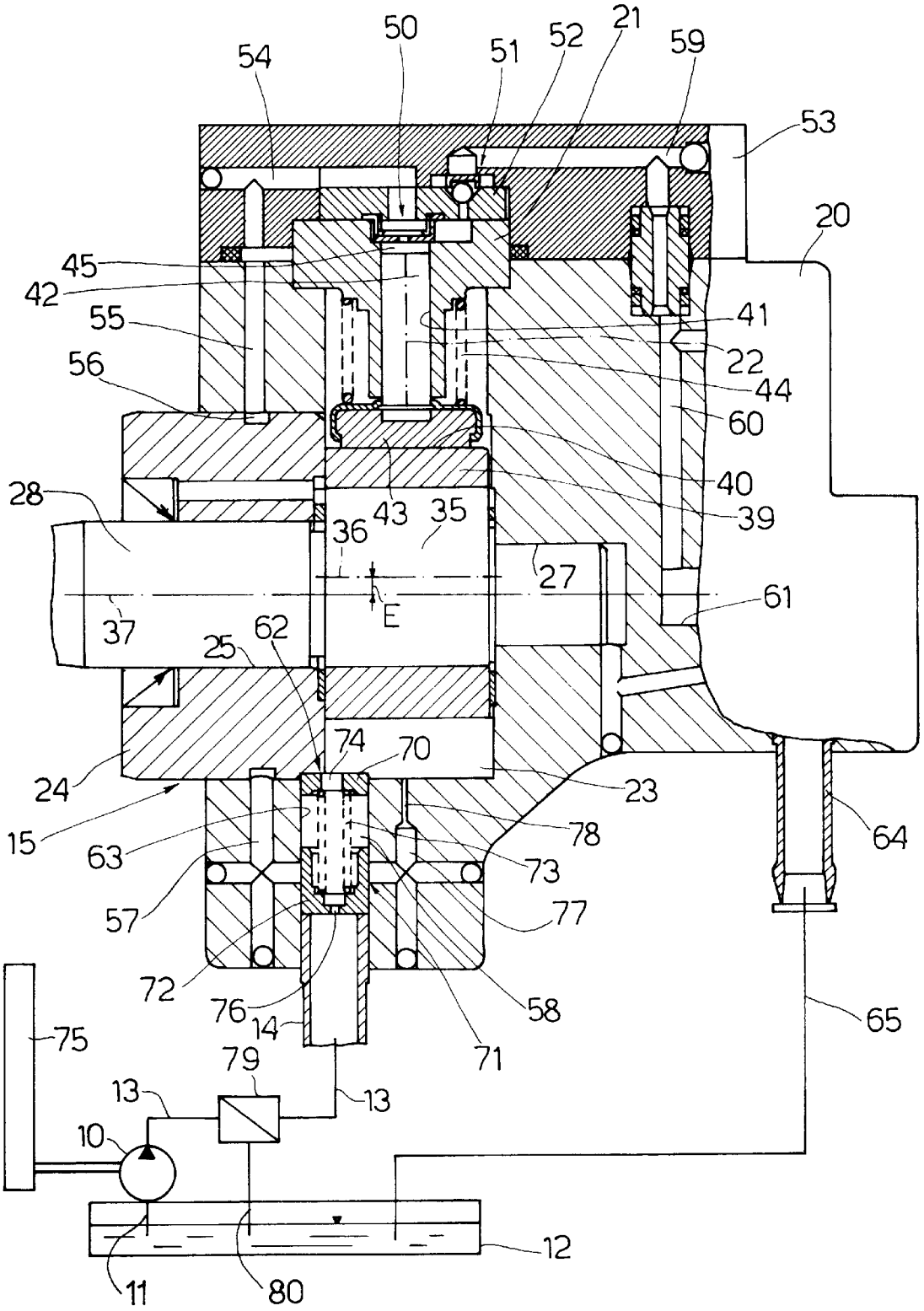
50
51
52
21
59
54
53
20
45
42
55
41
22
56
44
60
40
28
43
35
39
36
27
61
37
E
62
25
74
70
24
23
15
78
63
73
64
57
77
72
76
58
65
14
71
75
79
13
13
10
12
11
80

PERFECTED PUMPING DEVICE FOR FEEDING FUEL FROM A TANK TO AN INTERNAL COMBUSTION ENGINE

BACKGROUND OF THE INVENTION

The present invention relates to a perfected pumping device for feeding fuel from a tank to an internal combustion engine, and comprising a high-pressure pump and a low-pressure pump connected upstream from the high-pressure pump.

A pumping device of the above type is described, for example, in Italian Patent Application n. TO95A000010 filed on Jan. 10, 1995 (corresponding to U.S. Pat. No. 5,571,243), by the present Applicant, and is used as part of a fuel injection system also comprising an on-off valve, which, when idle, disconnects the two pumps, is opened by the fuel pressure of the low-pressure pump to supply the engine, and also provides for feeding the surplus fuel into an inner chamber of the high-pressure pump for lubrication and cooling purposes.

In the known device, the high-pressure pump is a piston type activated by the drive shaft; the low-pressure pump is activated by an electric motor; and the on-off valve is so sized as to supply the high-pressure pump and the inner chamber with the necessary amount of fuel as of the cranking stage. Operation of the electric motor powering the low-pressure pump, however, is generally unreliable, and, what is more, places added stress on the battery precisely at the cranking stage.

Replacing the electrically powered low-pressure pump with one activated by the drive shaft has so far been unfeasible, due to the low-pressure pump, at low engine speed at the cranking stage, being unable to supply enough fuel to open the on-off valve. On the other hand, sizing the on-off valve to enable it to be opened even under low fuel supply conditions would result in high steady-state fuel supply by the low-pressure pump, thus increasing the fuel pressure in the low-pressure circuit and so requiring a pressure regulator between the two pumps.

SUMMARY OF THE INVENTION

It is an object of the present invention to provide a highly straightforward, reliable fuel pumping device designed to overcome the aforementioned drawbacks in connection with the on-off valve.

According to the present invention, there is provided a pumping device for feeding fuel from a tank to an internal combustion engine, and comprising a low-pressure pump; a high-pressure pump in turn comprising a body forming an inner chamber, and at least one piston activated by a control element housed in said inner chamber; and an on-off valve housed in a connection between said low-pressure pump and said high-pressure pump; said on-off valve comprising a member activated by the fuel from said low-pressure pump to open an intake channel in said connection and feed surplus fuel to said inner chamber; characterized in that said low-pressure pump is activated mechanically by means connected to the shaft of said engine; said member being so sized as to be activated even at low cranking speed of said engine.

BRIEF DESCRIPTION OF THE DRAWINGS

A preferred, non-limiting embodiment of the present invention will be described by way of example with reference to the accompanying drawing, which shows a partly schematic, partial half section of a pumping device in accordance with the invention, for feeding fuel to an internal combustion engine.

DETAILED DESCRIPTION OF THE INVENTION

Number 10 in the accompanying drawing indicates a low-pressure fuel pump, which may comprise a rotary mechanical, e.g. gear, pump, and which is connected by a conduit 11 to a normal fuel tank 12, e.g. of a vehicle comprising an internal combustion engine, and in particular a diesel engine.

Pump 10 provides for drawing and feeding fuel from tank 12 along a conduit 13 and through a fitting 14 to a high-pressure radial-piston pump 15. More specifically, pump 15 comprises three cylinders 21 housed in a body 20 with their respective axes 22 equally spaced angularly 120° apart; and, at the center, body 20 comprises a cup-shaped inner chamber 23 closed by a flange 24.

Pump 15 comprises a drive shaft 28 rotating inside a hole 25 in flange 24 and inside a dead hole 27 in body 20, and which, to drive pump 15, is rotated by the drive shaft of the diesel engine via transmission means not shown. Shaft 28 comprises an eccentric portion 35 housed inside chamber 23 and fitted in rotary manner with a control element for controlling pump 15 and comprising a ring 39. The axis 36 of portion 35 is offset by distance E from the axis 37 of shaft 28.

The outer surface of ring 39 comprises three flat portions 40 (only one shown) associated with, and perpendicular to respective axes 22 of, cylinders 21; each cylinder 21 comprises a cylindrical hole 41 coaxial with respective axis 22 and in which slides a piston 42 projecting from cylinder 21 towards axis 37; and the projecting portion of each piston 42 is fitted with a pad 43, which is held against respective flat portion 40 by a spring 44.

When shaft 28 is rotated, ring 39 maintains its orientation by virtue of pad 43, whereas axis 36 of ring 39 rotates about axis 37 of shaft 28, so that flat portions 40 are moved parallel to themselves along a circular trajectory and, in conjunction with springs 44, move pistons 42 back and forth inside holes 41.

Inside hole 41, the surface of each piston 42 opposite ring 39 defines a compression chamber 45, the volume of which varies with the movement of piston 42; and each cylinder 21 comprises a nonreturn intake valve 50 and a nonreturn delivery valve 51, both seated in a plate 52 closing respective cylinder 21 and fitted to body 20 by a respective head 53. As piston 42 moves radially inwards, compression chamber 45 increases in volume and draws in fuel through intake valve 50; and, as piston 42 moves radially outwards, chamber 45 decreases in volume to compress and force the fuel under pressure out of chamber 45 through delivery valve 51.

Each intake valve 50 is supplied with fuel along a respective axial channel 54 formed in respective head 53, and along a respective radial channel 55 formed in body 20 next to flange 24; the three channels 55 communicate with an annular groove 56 formed in flange 24, and which in turn communicates with an intake channel 57 formed in body 20 and communicating with fitting 14; each of the three delivery valves 51 communicates with an axial cavity 61 along a respective axial channel 59 formed in respective head 53, and along a respective radial channel 60 formed in body 20; and, downstream from a bypass valve of a pressure regulator (not shown), cavity 61 is connected via a fitting 64 to a drain conduit 65 for draining fuel into tank 12.

An on-off valve 71 is fitted between low-pressure pump 10 and high-pressure pump 15, and comprises a body integrated with body 20 of pump 15. For which purpose, body 20 comprises a cylindrical seat 58 oriented radially with respect to axis 37 and communicating with inner chamber 23. The outward portion of seat 58 houses fitting 14 of conduit 13, while the portion of seat 58 adjacent to chamber 23 houses a bottom annular plate 70 resting on a shoulder 62 of flange 24, and comprising a hole 74 defining a first drain conduit for draining surplus fuel into inner chamber 23.

Seat 58 comprises a lateral surface 63 through which channel 57 comes out, and along which slides a control member for controlling valve 71 and comprising a cup-shaped piston 72 with a calibrated hole 76 defining a choke for the fuel flowing into inner chamber 23. A weak helical compression spring 73, located between plate 70 and piston 72 and coaxial with holes 74 and 76, pushes piston 72 towards fitting 14 to close channel 57 and valve 71.

Piston 72 is pushed in the opening direction of valve 71 by the pressure of the fuel supplied by low-pressure pump 10 along conduit 13. When the fuel supply pressure exceeds the force exerted by helical spring 73, piston 72 is moved towards plate 70 to open channel 57, which is supplied with fuel along conduit 13, while the surplus fuel flowing through choke 76 is fed through hole 74 into inner chamber 23 to lubricate the members housed inside the chamber. Conversely, when the fuel pressure falls below a given value, e.g. due to malfunctioning of pump 10 or an emergency maneuver, spring 73 pushes piston 72 against fitting 14 to close channel 57 and so close on-off valve 71.

According to the invention, low-pressure pump 10 is activated mechanically by transmission means 75 connected to the vehicle diesel engine shaft; and, to enable valve 71 to be opened even at cranking speed, when the engine shaft is rotating at low speed, choke 76 of piston 72 has a very small diameter of about 0.2 mm.

Moreover, body 20 comprises a second channel 77, which, on one side, comes out through lateral surface 63 of seat 58, and, at the other, comprises a calibrated choke 78 along which it comes out inside inner chamber 23 of pump 15. Channel 77 may advantageously be of the same diameter as channel 57, and may come out inside seat 58 so as to be opened and closed by piston 72 simultaneously with channel 57; and the diameter of choke 78 may range between three and five times that of choke 76, and may advantageously be of about 0.8 mm.

As the diesel engine shaft is rotated by the battery at the cranking stage, low-pressure pump 10 is activated via transmission means 75; by virtue of the small diameter of choke 76, the small amount of fuel supplied by pump 10 at the cranking stage is sufficient to create enough pressure in fitting 14 to overcome spring 73 and move piston 72 to open valve 71; and, even at such low speed, hole 74 allows the members inside chamber 23 to be lubricated by the fuel flowing through choke 76.

As soon as piston 72 is moved, and as channel 57 begins feeding fuel to compression chambers 45 of pump 15, choke 78 of channel 77 supplies inner chamber 23 with the surplus fuel supplied by pump 10 as a result of the increase in engine speed following the cranking stage, so as to effectively cool the members inside chamber 23 at steady engine speed.

To cut off fuel supply to on-off valve 71, conduit 13 is fitted, between low-pressure pump 10 and high-pressure pump 15, with a solenoid valve 79 connected to tank 12 by a drain conduit 80.

In the event of a fault on the diesel engine, or any other defects, solenoid valve 79 is activated automatically, e.g. by an electronic central control unit, without having to stop pump 10. More specifically, in the event of a fault or in emergency situations, solenoid valve 79 cuts of fuel supply from pump 10 to pump 15, and piston 72 prevents the fuel in chamber 23 from being supplied to compression chamber 45.

The advantages of the device according to the invention, and as compared with known devices, will be clear from the foregoing description. In particular, low-pressure pump 10 may be effectively activated by the diesel engine itself; the problem posed by the variation in the fuel supply of low-pressure pump 10 between the cranking stage and steady running speed of the engine is solved; and, finally, in the event of operating defects, fuel supply to on-off valve 71 is cut off without having to stop low-pressure pump 10.

Clearly, changes may be made to the device as described and illustrated herein without, however, departing from the scope of the present invention. For example, means 75 may be activated by shaft 28 of high-pressure pump 15, so that both pumps 10 and 15 may be integrated in the same body 20.

I claim:

1. A pumping device for feeding fuel from a tank to an internal combustion engine, and comprising a low-pressure pump; a high pressure pump in turn comprising a body forming an inner chamber, and at least one piston activated by a control element housed in said inner chamber and an on-off valve housed in a connection between said low-pressure pump and said high-pressure pump; said on-off valve comprising a member activated by the fuel from said low-pressure pump to open an intake channel in said connection and feed surplus fuel to said inner chamber; characterized in that said low-pressure pump is activated mechanically by means connected to the shaft of said engine; said member having a choke having a diameter sufficiently small to be activated at the cranking speed of said engine, wherein said on-off valve comprises an opening communicating with said inner chamber; characterized in that, when activated, said member also provides for opening an additional opening communicating with said inner chamber.

2. A pumping device as claimed in claim 1, wherein said body of said high-pressure pump also forms the body of said on-off valve; said additional opening being defined by a further channel in said body.

3. A pumping device as claimed in claim 1, characterized in that, between said low-pressure pump and said on-off valve, there is provided a solenoid valve, which is activated to cut off fuel supply to the on-off valve in the event of a malfunction of said engine.

4. A pumping device as claimed in claim 3, characterized in that said solenoid valve is connected by a drain conduit to said tank to drain the fuel of said low-pressure pump into said tank in the event of a fault.

5. A pumping device as claimed in claim 1, characterized in that said high-pressure pump is a radial-piston pump, and said control element is an eccentric element rotating in said inner chamber; said surplus fuel lubricating and cooling said eccentric element.

6. A pumping device as claimed in claim 5, wherein said member is in the form of a cup-shaped piston, and a seat is cylindrical; characterized in that said seat houses a cylindrical bottom plate comprising said first opening; and a helical spring is preloaded between said bottom plate and said cup-shaped piston; said first opening and said inlet choke being located inside the turns of said helical spring.

7. A pumping device for feeding fuel from a tank to an internal combustion engine, and comprising a low-pressure pump; a high pressure pump in turn comprising a body forming an inner chamber, and at least one piston activated by a control element housed in said inner chamber and an on-off valve housed in a connection between said low-pressure pump and said high-pressure pump; said on-off valve comprising a member activated by the fuel from said low-pressure pump to open an intake channel in said connection and feed surplus fuel to said inner chamber; characterized in that said low-pressure pump is activated mechanically by means connected to the shaft of said engine; said member having a choke having a diameter sufficiently small to be activated at the cranking speed of said engine, wherein said member is movable along a lateral wall of a seat; said intake channel coming out through said lateral wall; characterized in that a further channel also comes out through said lateral wall.

8. A pumping device as claimed in claim 7, characterized in that said channels are opened simultaneously by said member; said further channel communicating with said inner chamber via a second calibrated choke.

9. A pumping device as claimed in claim 8, characterized in that the diameter of said second choke is from three to five times the diameter of said inlet choke.

10. A pumping device as claimed in claim 9, characterized in that the diameter of said inlet choke is about 0.2 mm, and the diameter of said second choke is about 0.8 mm.

* * * * *